US010281880B2

(12) United States Patent
Zanesco et al.

(10) Patent No.: US 10,281,880 B2
(45) Date of Patent: May 7, 2019

(54) ELECTRONIC TIMEPIECE WITH TWO ANALOGUE TYPE HANDS

(71) Applicant: ETA SA Manufacture Horlogere Suisse, Grenchen (CH)

(72) Inventors: Vittorio Zanesco, Neuchatel (CH); Pascal Lagorgette, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 4 days.

(21) Appl. No.: 15/686,624

(22) Filed: Aug. 25, 2017

(65) Prior Publication Data

US 2018/0081323 A1 Mar. 22, 2018

(30) Foreign Application Priority Data

Sep. 22, 2016 (EP) ..... 16190169

(51) Int. Cl.

| | |
|---|---|
| ***G04C 17/00*** | (2006.01) |
| ***G04C 10/04*** | (2006.01) |
| ***G04B 19/04*** | (2006.01) |
| ***G04C 3/14*** | (2006.01) |
| ***G04G 9/00*** | (2006.01) |

(52) U.S. Cl.

CPC ..... *G04C 10/04* (2013.01); *G04B 19/04* (2013.01); *G04C 3/14* (2013.01); *G04C 17/00* (2013.01); *G04G 9/0064* (2013.01); *G04C 3/146* (2013.01)

(58) Field of Classification Search

CPC ..... G04C 10/04; G04C 3/14; G04C 3/146; G04C 17/00; G04B 19/04; G04G 9/0064

See application file for complete search history.

(56) References Cited

U.S. PATENT DOCUMENTS

| | | | | |
|---|---|---|---|---|
| 4,028,880 | A | 6/1977 | Ueda | |
| 4,266,288 | A * | 5/1981 | Berney | G04C 3/14 368/185 |
| 5,299,177 | A | 3/1994 | Koch | |
| 6,901,032 | B1 * | 5/2005 | Eo | G04B 19/26 368/15 |

(Continued)

FOREIGN PATENT DOCUMENTS

| | | |
|---|---|---|
| EP | 0 589 353 A1 | 3/1994 |
| EP | 1 748 331 A1 | 1/2007 |

OTHER PUBLICATIONS

European Search Report dated Mar. 27, 2017 in European Application 16190169.9, filed on Sep. 22, 2016 (with English Translation of Categories of cited documents and Written Opinion).

*Primary Examiner* — Sean P Kayes
(74) *Attorney, Agent, or Firm* — Oblon, McClelland, Maier & Neustadt, L.L.P.

(57) ABSTRACT

The present invention concerns an electronic timepiece with two analog type hands. The timepiece includes an hour hand and a minute hand, the hour hand and the minute hand being arranged to operate independently of each other. The hour hand and the minute hand are arranged to operate in a first operating mode and in a second operating mode, which is arranged to be actuated by the timepiece detecting an event. In the second operating mode, the hour hand and the minute hand are arranged to operate in a different manner from their mode of operation in the first operating mode.

12 Claims, 1 Drawing Sheet

(56) References Cited

U.S. PATENT DOCUMENTS

| | | | | |
|---|---|---|---|---|
| 7,492,671 | B2 * | 2/2009 | Ogasawara | G04R 20/08 368/21 |
| 9,442,465 | B2 * | 9/2016 | Yamamoto | G04G 19/08 |
| 9,483,022 | B1 * | 11/2016 | Avetyan | G04G 21/00 |
| 9,740,172 | B2 * | 8/2017 | Kojima | G04B 19/247 |
| 2003/0076746 | A1 * | 4/2003 | Palmer | G04B 19/04 368/80 |
| 2006/0092770 | A1 * | 5/2006 | Demas | G04B 19/235 368/223 |
| 2007/0025186 | A1 | 2/2007 | Gilomen | |
| 2016/0139569 | A1 * | 5/2016 | Yamamoto | G04G 19/08 368/155 |
| 2016/0252883 | A1 * | 9/2016 | Inoue | G04B 47/063 368/11 |

* cited by examiner

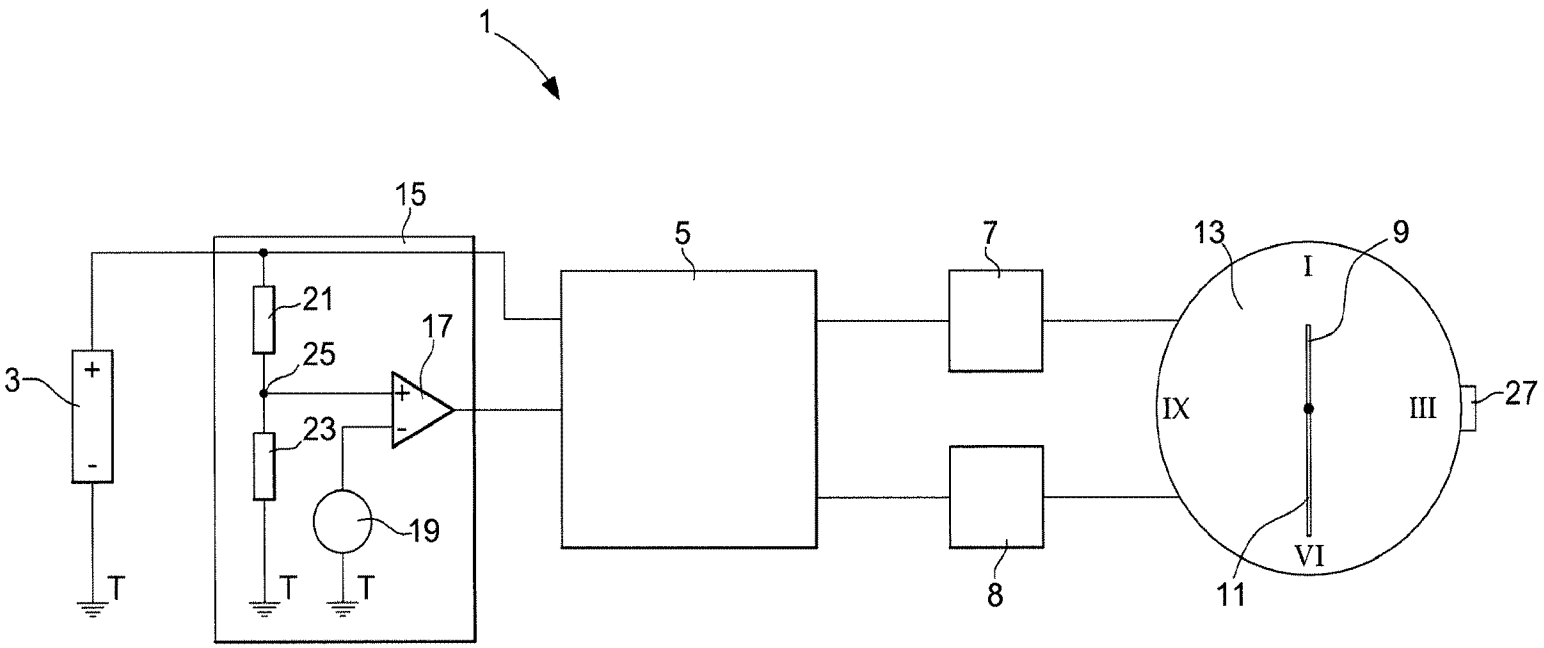
1
3
+
-
T
15
21
25
23
17
19
5
7
8
13
9
11
I
III
VI
IX
27

ELECTRONIC TIMEPIECE WITH TWO ANALOGUE TYPE HANDS

This application claims priority from European Patent Application No. 16190169.9 filed on Sep. 22, 2016, the entire disclosure of which is hereby incorporated herein by reference.

FIELD OF THE INVENTION

The invention relates to a timepiece with two analogue type hands. More specifically, the invention relates to a timepiece comprising only two hands, which make it possible to display different functions from those for which they are initially intended or for displaying information in a different way from the way in which it is initially displayed.

BACKGROUND OF THE INVENTION

The most significant problem encountered with an electronic timepiece, such as a battery-operated wristwatch, is the end of battery life. As the end of battery life approaches, the battery voltage decreases, thereby causing disruption to operation of the timepiece and, when the end of battery life is reached, the timepiece stops working. According to several known solutions, to indicate the end of battery life, the timepiece can be provided with a light element, which has a predetermined operating voltage, and the light element produces intermittent light signals. In this arrangement, several days before the end of battery life, the battery voltage drops below the operating voltage of the light element, which is no longer capable of operation. According to another method, the light element is normally kept in an inactive state, but it can produce intermittent light signals when the battery voltage drops below a predetermined value. In the first method, since the light element constantly produces light signals, the power consumed is high, so that it is necessary to use a higher capacity battery. In the second method, the power consumption increases as the end of battery life approaches, which accelerates the depletion of the battery.

It is also to be noted that, for a timepiece with only two hands, it is not known to indicate the end of battery life via a light signal as described above. Generally, with a timepiece having two indicator hands, there are no additional means provided able to indicate the end of battery life in a simple manner, which is a drawback.

Another problem encountered with a timepiece, especially a timepiece with two hands, is that it is not possible to operate the hands easily, or to change the way they normally work. At present, a timepiece with two hands includes an hour hand for indicating the hour, and a minute hand for indicating the minutes. However, it would be desirable to be able to actuate or move the hands in a more flexible manner.

It is thus an object of the present invention to overcome the problems identified above relating to electronic timepieces with an analogue display.

SUMMARY OF THE INVENTION

The present invention therefore proposes an electronic timepiece with two analogue display hands, as explained in more detail below. To this end, a first aspect of the invention concerns an electronic timepiece with two analogue display hands, the timepiece including an hour hand and a minute hand, the hour hand and the minute hand being arranged to operate independently of each other, the hour hand and the minute hand being arranged to operate in a first operating mode and in a second operating mode, which is arranged to be actuated by the timepiece detecting a determined event, wherein in the second operating mode, the hour hand and the minute hand are arranged to operate in a different manner from their mode of operation in the first operating mode, wherein in the first operating mode, the hour hand indicates the hour in a jumping manner, while the minute hand indicates the minutes in a sliding or jumping manner, and wherein after the second operating mode, the timepiece is arranged to return to the first operating mode, after detecting another event or after a determined time.

Advantageously, with the present solution, it is possible to produce a timepiece having the possibility of displaying several functions using a movement with two hands. Said movement has a small thickness and a reduced movement cost. The movement is composed of few mechanical components compared to a movement with three hands. The timepiece proposed provides an on-demand display of the seconds using a simple movement with two hands. The timepiece proposed also makes it possible to display the end of battery life using a movement with two hands. Unlike movements of the prior art, in which each display function has its own hand or its own indicator disc, the present invention intends to display on demand the hour and minutes, the date and the seconds with only two hands.

Other aspects of the present invention are defined in the dependent claims.

BRIEF DESCRIPTION OF THE DRAWINGS

The invention will be clearly understood upon reading the following description given by way of non-limiting example with reference to the attached drawing, which schematically represents:

FIG. 1 represents a simplified schematic view illustrating a timepiece according to an embodiment of the present invention.

DETAILED DESCRIPTION OF THE INVENTION

Referring to FIG. 1, an embodiment conforming to the present invention is now explained in more detail. This embodiment is described in the context of an electronic wristwatch with an analogue display. However, the present invention is not limited merely to wristwatches. As regards the number of hands, the watch of the present invention comprises only two hands, in particular, a first hand, which as illustrated is an hour hand, and a second hand, which as illustrated is a minute hand.

With reference to FIG. 1, watch 1, which is schematically represented, includes an electric power source 3 formed by a battery, which powers an electronic circuit and, via this circuit, a first electric motor 7, which actuates the hour hand 9, and a second electric motor 8, which actuates the minute hand 11. In this manner, the operation of these two hands can be independently controlled. The two electric motors may be stepping motors for example. Dial 13 of the watch is visible behind hands 9, 11.

The electronic circuit mainly includes a quartz oscillator (not illustrated) associated with a timepiece type microprocessor 5, which directly controls motors 7, 8, and a circuit 15 for monitoring the battery voltage. This monitoring circuit 15 essentially includes a comparator 17, a special circuit 19 arranged for storing, for example, a reference voltage threshold, or an internal resistance threshold, and two resistors 21 and 23 respectively called divider bridge resistors. Special circuit 19 is known in particular from Swiss Patent CH 651 999. A connection node 25 of the two resistors 21 and 23 is connected to a positive terminal of comparator 17. The other terminal of resistor 23 is connected to earth T. The other terminal of resistor 21 is connected to the positive terminal of the battery. The negative input of comparator 17 is connected to a terminal of special circuit 19, whose other terminal is connected to earth T. The output of comparator 17 is connected to microprocessor 5.

Monitoring circuit 15 is arranged to detect the battery voltage or its internal resistance and to compare it to a predetermined threshold value. When the effective value of the voltage or of the internal resistance reaches the respective threshold value, monitoring circuit 15 transmits appropriate information to microprocessor 5, which controls motors 7, 8.

As regards hands 9, 11, and given that watch 1 of the present invention has only two hands, at least two operating modes or operational modes are proposed for the hands in order to indicate more information than a prior art watch with two hands. A first operating mode may be considered to be the normal operating mode, whereas a second operating mode is an alternative operating mode. The second operating mode is actuated by an event detected by the watch. This event may be, for example, an action performed by the wearer or user of watch 1, or an event that does not require any intervention by the wearer of watch 1. After the second operating mode, the watch may return to the first operating mode, after detecting a determined event or after a determined time.

According to this embodiment of the present invention with the normal operating mode, hour hand 9 operates in a manner defined as "jumping". In other words, hour hand 9 indicates the hour by jumping. For example, from 13h00 to 13h59, hour hand 9 is positioned on dial 13 in position "1" as represented in FIG. 1, then from 14h00 to 14h59 in position "2", and so on. It can thus be observed that, in the normal operating mode, in this example, hour hand 9 makes a jump at each hour, i.e. one jump per hour. In the normal operating mode, minute hand 11 indicates the minutes in a jumping or sliding manner. In this normal operating mode, the watch displays the hour and the minutes.

According to a first variant of the present invention, the second operating mode is not necessarily related to the fact that battery 3 is approaching the end of life threshold. Indeed, in this variant, the second operating mode may be initiated by the wearer of watch 1 through the action or operation of a control means 27 of watch 1. This control means 27 may be, for example, a crown stem 27 of watch 1. The wearer of the watch can thus initiate the second operating mode by pressing on stem 27 or by pulling stem 27. According to this variant, at the user's request, by simply pressing on stem 27, hour hand 9 becomes a sliding hand and the minute hand indicates the seconds. Given that the time is indicated in a sliding manner, the user can tell the exact time quite precisely, even though minute hand 11 is currently indicating the seconds. After a determined time, the hands indicate the hour and minutes again. It is thus possible to arrange for the operating mode to automatically change to the first operating mode, which is the normal operating mode, after a determined time. Alternatively, watch 1 may return to the first operating mode through an action performed by the user. For example, the wearer of watch 1 can operate control means 27 again. This other action may be a reverse action, i.e. pushing the crown stem rather than pulling it, which is the action performed to actuate the second operating mode.

According to a second variant of the present invention, activation of the second operating mode is not related to an action performed by the user. In this variant, the moment of changing the operating mode to the second operating mode is linked to detection of the end of life of battery 3. Once the end of life of battery 3 is detected, normal operation of the hands can be changed to provide the user with additional information, which he can interpret as indicating the end of life of battery 3. In other words, the state of watch 1 changes from the first operating mode to the second operating mode. Here too, the first operating mode corresponds to a normal operating mode, whereas the second operating mode corresponds to an alternative operating mode, i.e., in this case, it is a battery end of life operating mode.

For example, more specifically, in the battery end of life operating mode, hour hand 9 operates in a sliding manner, whereas minute hand 11 becomes the seconds hand and jumps at each predetermined interval. This interval is typically more than one second, for example two, three, four or five seconds, or even more. It is also possible to increase this interval gradually as the end of life of battery 3 approaches. For example, several thresholds can be defined and saved in monitoring circuit 15. If a first threshold has been exceeded, the interval becomes equal to two seconds, while if a third threshold has been exceeded, the interval becomes equal to three seconds and so on.

According to a third variant, as the end of life of battery 3 approaches, hour hand 9 and minute hand 11 become superposed in a sliding display of the time. According to a fourth variant, in the battery end of life operating mode, minute hand 11 may be arranged to advance in 5-minute jumps.

As described above, when a crown without mechanical connections, called an electronic crown, drives hands independently, this offers numerous possibilities for operating and displaying functions on demand. Several operations possible in an hour/minute movement whose hands are independent of each other were described above. Other variants may also be envisaged. For example, it is also possible to indicate the date. More specifically, one of the hands, for example minute hand 11, may indicate the day, while the other hand, for example the hour hand, may indicate the month. It is also possible for minute hand 11 to indicate the day, while hour hand 9 operates in a sliding manner.

It is also possible to envisage other variants in the configurations explained above without departing from the scope of the present invention. For example, in the first operating mode, the hands may operate in a different manner from their mode of operation explained above.

What is claimed is:

1. An electronic timepiece comprising:

two analogue display hands, including an hour hand and a minute hand, the hour hand and the minute hand being arranged to operate independently of each other, the hour hand and the minute hand being arranged to operate in a first operating mode and in a second operating mode, the second operating mode being actuated by the timepiece detecting a determined event, wherein in the second operating mode, the hour hand and the minute hand are arranged to operate in a different manner from their mode of operation in the first operating mode, wherein in the first operating mode, the hour hand indicates the hour by jumping from one hour to the next hour every hour, while the minute hand indicates the minutes, wherein in the second operating mode, the hour hand indicates the hour by sliding continuously from one hour to the next, whereas the minute hand indicates the seconds, and wherein after the second operating mode, the timepiece is arranged to return to the first operating mode, after detecting another event or after a determined time.

2. The timepiece according to claim 1, wherein the second operating mode is arranged to be actuated by a user of the timepiece through the action or operation of a control means.

3. The timepiece according to claim 2, wherein the control means comprises a crown stem of the timepiece.

4. The timepiece according to claim 1, wherein the timepiece includes a power source, and wherein the second operating mode is arranged to be actuated by the timepiece detecting the end of life of the power source.

5. The timepiece according to claim 1, wherein the other event is an action initiated by a user of the timepiece.

6. The timepiece according to claim 1, wherein the minute hand is arranged to jump from one second to the next second at a determined interval in the second operating mode, wherein the determined interval is between 2 seconds and 10 seconds.

7. The timepiece according to claim 6, wherein a duration of the determined interval depends on a state of charge of a power source of the timepiece.

8. The timepiece according to claim 7, wherein the determined interval is arranged to become gradually longer as the state of charge diminishes.

9. The timepiece according to claim 1, wherein in the second operating mode, the hour hand and the minute hand are superposed, indicating the time in a sliding manner.

10. The timepiece according to claim 1, wherein in the second operating mode, the hour hand indicates at least part of the date.

11. The timepiece according to claim 1, wherein the timepiece is a wristwatch.

12. The timepiece according to claim 1, wherein, in the first operating mode, the minute hand indicates the minutes by continuously sliding from one minute to the next minute or jumping from one minute to the next minute every minute.

* * * * *